US006175979B1

(12) United States Patent
Jackson

(10) Patent No.: US 6,175,979 B1
(45) Date of Patent: Jan. 23, 2001

(54) INFLATABLE ORTHOPEDIC PILLOW

(76) Inventor: John C. Jackson, 313 S. Lakeside Dr., Lake Worth, FL (US) 33460

( * ) Notice: Under 35 U.S.C. 154(b), the term of this patent shall be extended for 0 days.

(21) Appl. No.: 09/427,655

(22) Filed: Oct. 26, 1999

Related U.S. Application Data

(63) Continuation-in-part of application No. 29/101,490, filed on Mar. 5, 1999, now Pat. No. Des. 416,428.

(51) Int. Cl.[7] ..... A61G 7/075
(52) U.S. Cl. ..... 5/648; 5/651
(58) Field of Search ..... 602/27; 128/885; 5/638, 644, 648, 649, 650, 651

(56) References Cited

U.S. PATENT DOCUMENTS 3,315,282 * 4/1967 Lowery et al. ..... 5/638
3,644,949 * 2/1972 Diamond ..... 5/644 X
4,278,079 * 7/1981 Simhoni et al. ..... 5/649
5,095,569 * 3/1992 Glenn ..... 5/638 X
5,173,979 * 12/1992 Nennhaus ..... 5/648
5,745,939 * 5/1998 Flick et al. ..... 5/648
5,997,491 * 12/1999 Harris ..... 5/648 X

* cited by examiner

*Primary Examiner*—Michael F. Trettel
(74) *Attorney, Agent, or Firm*—McHale & Slavin

(57) ABSTRACT

The present invention is an inflatable orthopedic pillow having both a size and shape effective to maintain elevation of one or both of a patient's lower extremities to a position favorable for the reduction of chronic edematous swelling. The shape and construction of the device provides an area effective for the isolation of a patient's foot so that the heel and surrounding area is floating in midair. At the same time, the entire leg is cradled upon an inflated surface which yields to pressure and thus minimizes the formation of secondary ulcers due to prolonged periods of contact of the surrounding tissues with the device.

4 Claims, 2 Drawing Sheets

INFLATABLE ORTHOPEDIC PILLOW

REFERENCE TO RELATED APPLICATIONS

This application is a continuation-in-part of Ser. No. 29/101,490, filed Mar. 5, 1999, now U.S. Pat. No. Des. 416,428, issued Nov. 16, 1999, the contents of which are herein incorporated by reference.

FIELD OF THE INVENTION

This invention relates to an orthopedic device for providing support to an upper or lower extremity and particularly relates to an inflatable device for isolating the heel to mediate the resolution of heel ulcers.

BACKGROUND OF THE INVENTION

A variety of patients populate the cohort of those at increased risk for the development of chronic lower extremity ulcerations. Among these are patients having impaired microcirculation to the lower extremities secondary to disease, e.g. diabetes, autoimmune diseases which attack the endothelium, Raynaud's disease, etc.; those patients suffering from decreased circulation due to cardiac insufficiency, for example congestive heart failure, those patients suffering a reduction in arterial perfusion due to abnormally high venous pressure and edema; and those who have suffered trauma to the lower extremities as a result of surgery or accident.

A common problem with all such patients is difficulty in the healing process. Due to the decreased perfusion of oxygenated blood, tissue breakdown occurs and ultimately results in the formation of ulcers. Of particular concern is the formation of decubitus ulcers of the heel, which are especially refractory to treatment due to the difficulty in removing contact pressure from the heel area. Whether walking about, wearing shoes and stockings, or merely lying in bed, the heel maintains virtually constant physical contact with an adjacent surface, e.g. a shoe, a stocking, a bed sheet or a footstool.

Medical professionals counsel their patients that healing of such ulcerations requires both elevation of the extremity and isolation of the wound area from the trauma of physical contact. Elevation is necessary for mediating chronic edema and abnormally high venous pressure, thereby encouraging an increase in the perfusion of oxygenated arterial blood flow to the area. Isolation of the area from physical contact promotes healing by reducing surface trauma and further debriding of the area due to friction. Isolation is also important since it allows medications to remain on the dermal and epidermal tissues thus reducing the incidence of infection.

Various apparatus have been used in an effort to accomplish the goals of isolation and elevation of the lower extremity, e.g. variously shaped foam pillows, stools, and slings or similar devices which wrap around the area allowing it to be hung from an overlying support. All of these devices have inherent drawbacks which result in a lack of compliance and increased morbidity. For example, pillows slip and change position and fall away or are pushed aside by the patient. Propping the extremity on a stool or similar device, or alternatively hanging the extremity in a sling leads to the manifestation of secondary problems, since there is always an area adjacent to the wound site which experiences increased pressure and physical trauma due to the device itself.

Thus, the prior art lacks a device which has the ability to provide elevation of a lower extremity, is capable of isolating a wound site from physical trauma, and is designed to maximize compliance and thereby increase the likelihood of a favorable outcome.

SUMMARY OF THE INVENTION

The present invention is an orthopedic pillow which is fully adjustable by inflation or deflation thereof, having both a size and shape effective to maintain elevation of one or both of a patient's extremities to a position favorable for the reduction of chronic edematous swelling. The shape and construction of the device provides an area effective for the isolation of a patient's foot so that the heel and surrounding area is floating in midair. At the same time, the entire leg is cradled upon an inflated surface which yields to pressure and thus minimizes the formation of secondary ulcers due to prolonged periods of contact of the surrounding tissues with the device. The device is light and easily maneuverable by both the patient and attending health professional or care giver. Furthermore, due to its inflatable design, the device is easily adjusted to a particular individual by increasing or decreasing the degree of inflation. The devices ease of use and simplicity assures increased compliance, comfort and effectiveness. The device is both exchangeable and reversible and can be used to prop up an individual's head or back, or to elevate legs or feet. The device is useful in bed or when lying on a couch or chair. The device has further utility in a surgical setting where it can be used to position an extremity so that operating room personnel may clean and isolate an area in preparation for surgery.

Accordingly, it is an objective of the instant invention to teach an adjustable device for elevating a lower extremity resulting in a reduction of swelling, increase in circulation and removal of all pressure from the heel and foot It is a further objective of the instant invention to teach a device for post-surgical treatment of a lower extremity to reduce post-operative pain and swelling and promote healing.

It is yet another objective of the instant invention to teach an orthopedic inflatable device for the treatment of chronic decubitus heel ulcers which isolate the ulcerated area from all pressure and physical contact.

These and other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
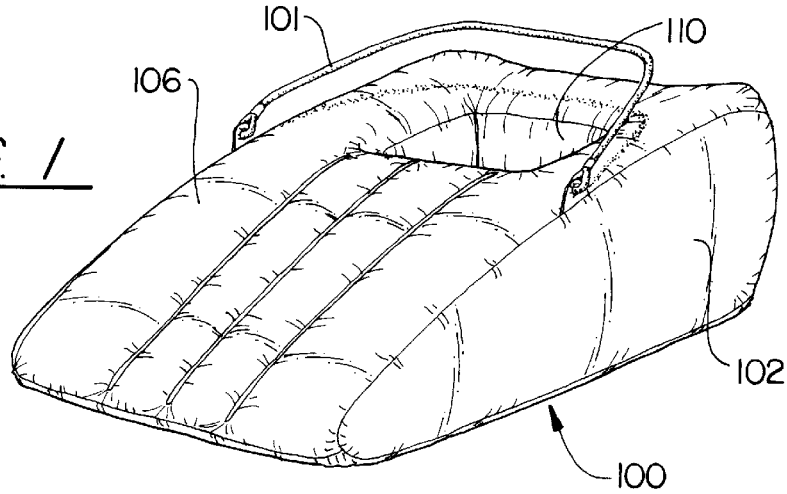
FIG. 1 is a perspective view of an orthopedic inflatable support device.
Figure 2:
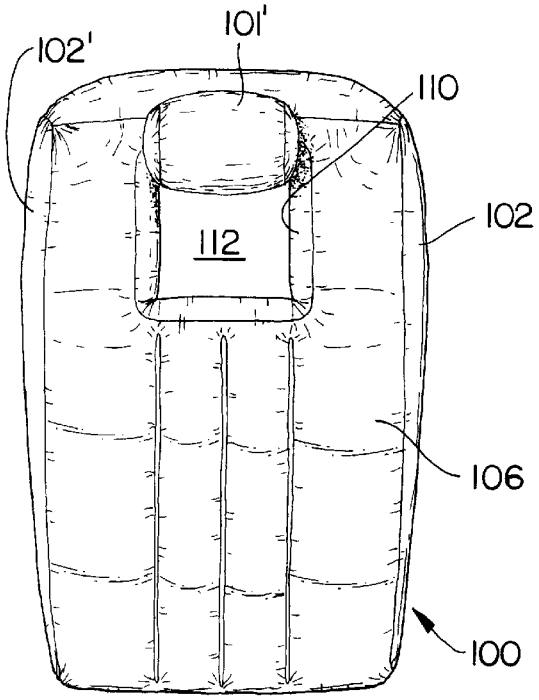
FIG. 2 is a top planar view of the device of FIG. 1.
Figure 4:
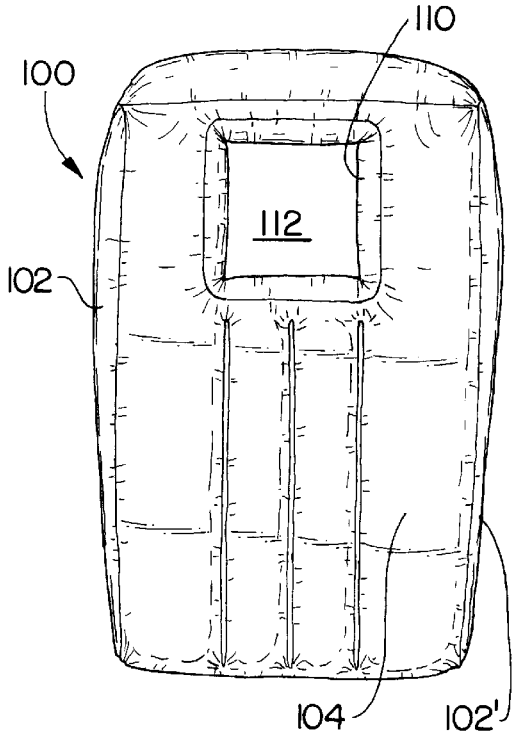
FIG. 4 is a bottom planar view of the device of FIG. 1.
Figure 5:
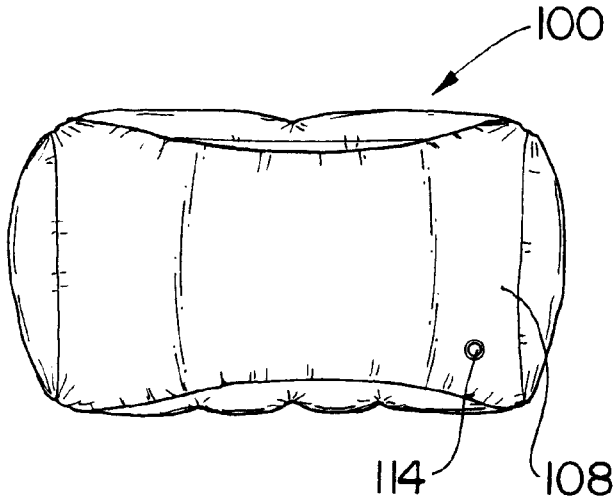
FIG. 5 is a rear planar view of the device of FIG. 1.
Figure 3:
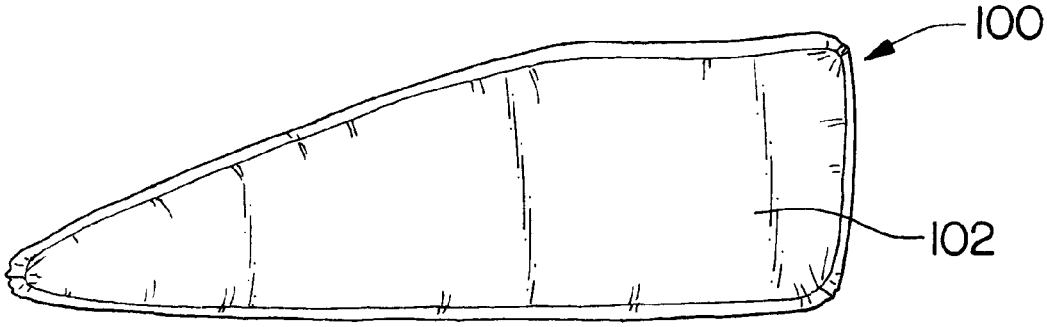
FIG. 3 is a side planar view of the device of FIG. 1.

With reference to FIGS. 1–5, in which like areas are numbered equivalently, an inflatable orthopedic pillow 100 is illustrated. The pillow is formed from a plurality of panels, specifically side panels 102, 102', a bottom panel 104, a top panel 106, a rear panel 108, and one or more panels 110 which form the internal perimeter of the central open area 112. Open area 112, while illustrated as essentially square, may have alternative functional shapes, for example, rectangular, round, oval or the like. The number of separate panels required to form the internal perimeter which defines open area 112 will vary dependent on the particular shape of choice. The panels are integrally combined to form an airtight structure. Non-limiting examples of methods of construction are ultrasonic welding, sewing, gluing, and the like. The hollow inflatable orthopedic pillow may be formed from various materials such as vinyl coated fabric, flexible polymer sheeting, or any similar flexible and air impervious material which can be manufactured into an inflatable and deflatable structure. The pillow can be further formed from alternative materials, e.g. leather, over which a skin protective covering formed from a soft material may be selectively attached to protect the skin of the patient from abrasion. Attachment may be made, for example, by a hook and loop style fastening system. Alternatively, the inflatable orthopedic device may be supplied with an easily replaceable and custom-fitted covering or case, to allow sanitary conditions to be maintained without taking the device out of service. Internal baffles (not shown) are an optional component and, when present, will aid in maintaining the pillow's shape and help to regulate the level of support. Inflation is accomplished by use of a valve 114 which is shown positioned on rear panel 108, but may be conveniently positioned at any location on the structure.

In operation the pillow 100 is inflated with air or another material such as sand, foam, water or the like to a degree which provides comfortable support. While an upper or lower extremity may be supported, or even the person's upper torso (positioning the head in the opening to allow breathing), for purposes of illustration, this discussion will focus on the patient's leg. The patient's foot is positioned over central open area 112 and is thereby permitted to float in midair. The incline of the device provides for a gradual elevation of the patient's leg to a point where the leg is positioned so as to promote enhanced arterial perfusion and a reduction of pain and swelling in the extremity. At the same time, the foot and heel area are maintained in this elevated position without application of pressure and without the incursion of secondary points of undue pressure which might otherwise promote ulcer formation in adjacent tissue structures. If desirable, the pillow may be further modified to include a foot drop strap 101 (FIG. 1) or a similarly positioned inflatable bulb-like device 101' (FIG. 2) or the like support device to aid in maintaining the positioning of the foot or other body portion in a particular position or orientation. The light weight and ease of use promotes increased patient compliance and thereby provides accelerated resolution of the ulcer and a reduction of the time of confinement.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. An inflatable orthopedic device for the treatment of at least one portion of a body consisting of:

a top panel, side panels, a bottom panel, a rear panel and at least one panel for defining the perimeter of an internal open area;

said panels being integrally bonded to form a discrete unitary airtight hollow pillow for support of said at least one portion of the body;

said device further characterized by an internal open area which provides means for elevated positioning of said at least one portion of the body with no physical contact thereto;

whereby healing of ulcerative conditions of the portion of the body treated are achieved.

2. The inflatable orthopedic device of claim 1 wherein the device further includes a skin protective covering attached thereto.

3. The inflatable orthopedic device of claim 1 further including means for maintaining said portion of the body in a particular orientation.

4. An inflatable orthopedic device for the treatment of a lower extremity consisting of:

a top panel, side panels, a bottom panel, a rear panel and at least one panel for defining the perimeter of an internal open area;

said panels being integrally bonded to form a discrete unitary airtight hollow pillow for support of said lower extremity;

said device further characterized by an internal open area which provides means for elevated positioning of said heel with no physical contact thereto;

whereby healing of heel ulcers are achieved.

* * * * *